United States Patent [19]

Berman

[11] Patent Number: 4,558,650

[45] Date of Patent: Dec. 17, 1985

[54] AUTOMATIC TELLER MACHINE ENCLOSURE

[76] Inventor: James Berman, New York, N.Y.

[21] Appl. No.: 556,966

[22] Filed: Dec. 1, 1983

[51] Int. Cl.[4] ..... G07F 5/00

[52] U.S. Cl. ..... 109/24.1; 109/2; 109/66

[58] Field of Search ..... 109/2, 19, 24.1, 40, 109/66, 71, 73; 221/186, 188

[56] References Cited

U.S. PATENT DOCUMENTS

| | | | |
|---|---|---|---|
| 3,682,113 | 8/1972 | McClellan et al. | 109/19 |
| 4,121,523 | 10/1978 | Hastings | 109/2 |
| 4,399,755 | 8/1983 | Wiedmann | 109/24.1 |

*Primary Examiner*—John J. Wilson
*Assistant Examiner*—David I. Tarnoff
*Attorney, Agent, or Firm*—McAulay, Fields, Fisher, Goldstein & Nissen

[57] ABSTRACT

A compact, secure enclosure for an automatic teller machine is provided. The automatic teller machine is of the type having a secure front panel and on operable rear panel. The enclosure is defined by a closed wall. The wall has a forward portion in which the automatic teller machine is located and a rearward portion which permits servicing of the automatic teller machine. The closed wall has a cut-out zone extending a substantial distance around the forward portion of the wall. The height of the cut-out zone is sufficient to accommodate the front face of the automatic teller machine. Within the forward portion of the enclosure a base is mounted which is capable of supporting the automatic teller machine. The base can be rotated 180° so that the automatic teller machine when supported thereon can assume at least three significant positions. A portion of the automatic teller machine projects outward from the wall when the automatic teller machine is supported on the base and is in any of its significant positions. First and second shields are mounted along the inner surface of the wall. The shields move along the cut-out zone as the base is rotated to provide continuous security for the cut-out zone. A lockable door is provided at the rear of the wall to allow a person to unlock same and enter into the enclosure.

7 Claims, 6 Drawing Figures

AUTOMATIC TELLER MACHINE ENCLOSURE

BACKGROUND OF THE INVENTION

This invention relates in general to a compact, secure enclosure for an automatic teller machine sometimes referred to as an ATM. More particularly, this invention is directed to an enclosure for a drive-up automatic teller machine installation.

Drive-up banking facilities commonly have a teller positioned on an island along side of which a car may pull up so that the driver may execute a banking transaction.

The space limitation imposed by these islands limits the usefulness of automatic teller machines because it is difficult to provide a secure space around the machines to service the machines either for the replacement of funds or for making repairs such as when cards or paper envelopes jam the machines.

In a drive-up banking facility the automatic teller machine must be positioned so that it is useable by the driver in the car and so that the enclosure for the teller is protected from accidental contact with the car.

Hence, the drive-up island presents a situation where space is limited but where for security and safety reasons somewhat substantial enclosed space is needed.

A free-standing enclosure for an automatic teller machine is disclosed in U.S. Pat. No. 4,399,755 issued on Aug. 23, 1983. The enclosure of the '755 patent provides only limited user access and only limited security. Specifically, the automatic teller machine is only accessible to a user in a single servicing position and more importantly, security is not provided while the machine is actually being rotated from its operative position to its servicing position and vice-versa.

Accordingly, it is a major purpose of this invention to provide an enclosure for an automatic teller machine which enclosure requires the allocation of a minimum of floor space and which enclosure provides both continuous secure access to the machine for the cash replacement and repair work and continuous user accessibility to the machine.

It is another object of the present invention to provide such an enclosure for an automatic teller machine which accommodates a machine having a portion projecting outwardly from the enclosure so that the machine is usable by a driver in a car.

Yet a further object of the present invention is to provide such an enclosure which is usable with currently manufactured and employed automatic teller machines.

An additional object of the present invention is to provide such an enclosure which is relocatable should the need be required.

BRIEF DESCRIPTION

In brief, one embodiment of this invention involves an enclosure, the wall of which is substantially two separated semi-cylinders connected by a straight wall portion. The enclosure has a roof and is dimensioned to fit on a typical drive-up teller island.

A continous closed wall defines the area of the enclosure. The enclosure has a forward portion in which the automatic teller machine is located and a rearward position to permit access for servicing the automatic teller machine.

The wall has a cut-out zone which extends a substantial distance around the forward portion of the wall.

The cut-out zone has a height which is sufficient to accommodate the front operating panel of the automatic teller machine.

A base pedestal which is capable of supporting the automatic teller machine is mounted for rotation within the forward portion of the enclosure. The base rotates 180° so that the automatic teller machine can assume at least three significant positions. A portion of the automatic teller machine projects outwardly from the wall through the cut-out zone.

At least two flexible shields are mounted for movement along the inner surface of the wall. The shields move along the cut-out zone when the base is rotated to continuously shield the cut-out zone in both significant positions and during the course of rotation from one position to the other position and back again.

A lockable door is provided at the rear of the wall to permit access into the enclosure by authorized personnel.

DESCRIPTION OF THE PREFERRED EMBODIMENTS

Figure 1:
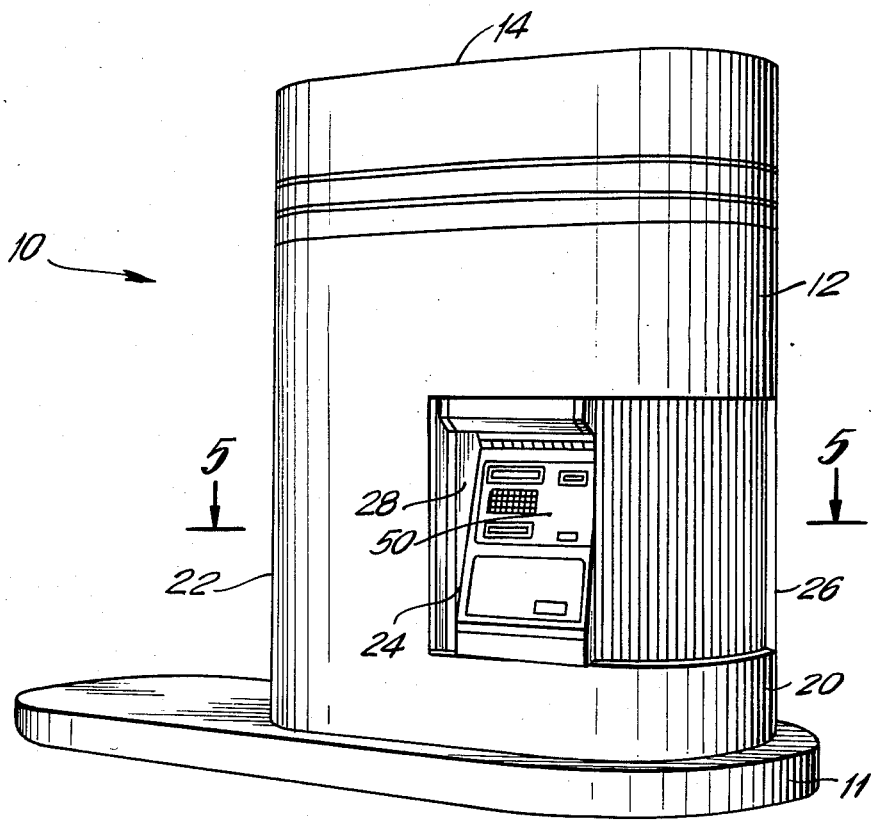
FIG. 1 is a perspective view of one embodiment of the enclosure of the present invention positioned on a drive-up island.

Referring now to the drawings, the enclosure 10 of the invention is defined by a closed wall 12. Enclosure 10 is divided generally into two portions, a forward portion 20 and a rearward portion 22. The enclosure 10 has a top 14 and a bottom (not shown). When installed in a drive-up facility, the enclosure can be positioned upon the drive-up island 11.

A cut-out zone 24 is formed in wall 12. Cut-out zone 24 extends a substantial distance around the forward portion 26 of the wall and has a height sufficient to accommodate the front operating panel 50 of an automatic teller machine 28.

A base 30 is positioned within forward portion 20 and is mounted for rotational movement. Base 30 is capable of supporting automatic teller machine 28.

Figure 5:
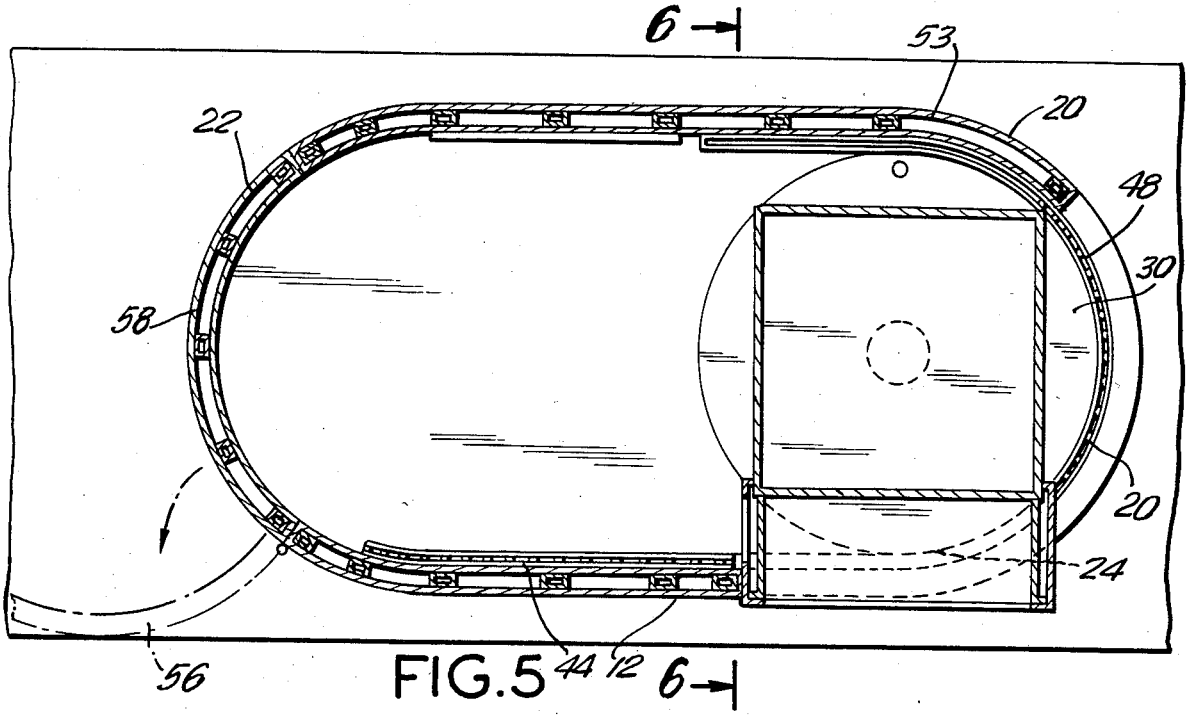
FIG. 5 is a horizontal sectional view taken generally along line 5—5 of FIG. 1.
Figure 6:
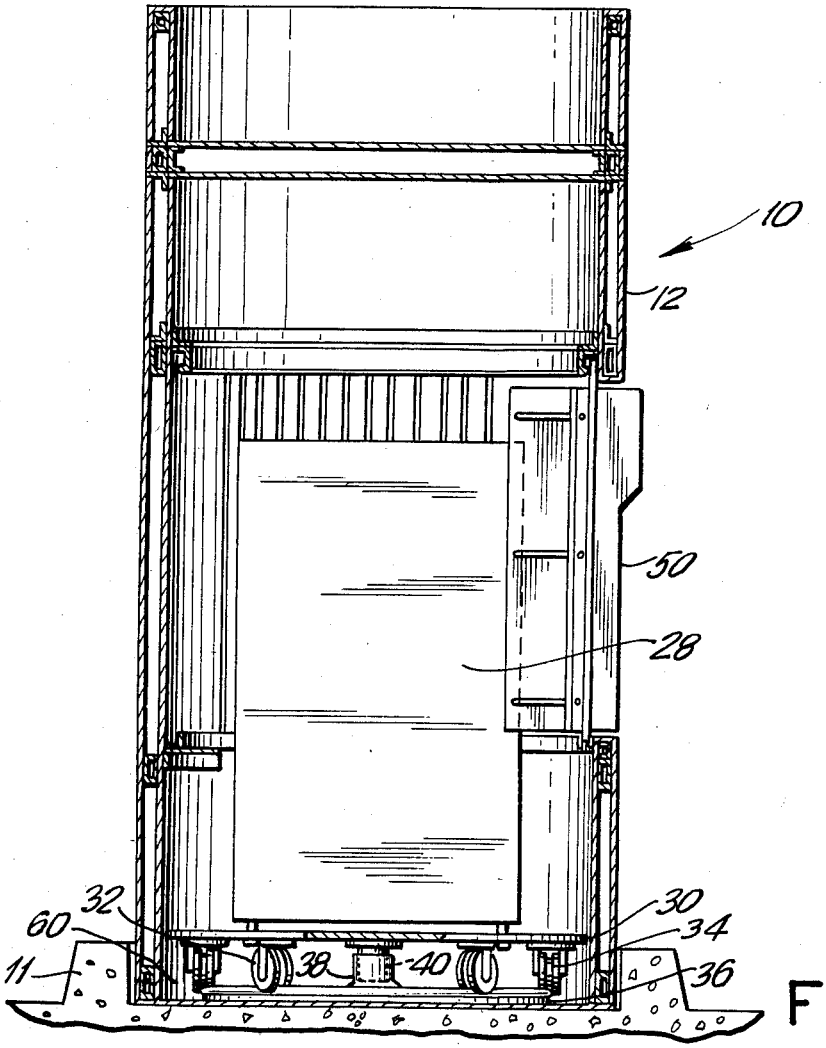
FIG. 6 is a vertical sectional view taken generally along line 6—6 of FIG. 5.

Grooved wheels 32 are attached to the bottom of base 30. A pipe track 34 is provided on which wheels 32 ride. This grooved wheel and pipe arrangement provides ease of movement by preventing fouling by dust and dirt which generate resistance to rotation. Base 30 with wheels 32 attached thereto rotates 180°. Pipe track 34 is welded to a steel plate 36. A central sleeve 38 and post 40 (see FIG. 5) prevent the base 30 from moving laterally and thus assure that the wheels 32 will not jump off pipe track 34.

Two flexible shields 44 and 48, which in a preferred embodiment are sliding steel tambour panels, engage the leading edge 42 and the trailing edge 44 of the rotatable automatic teller machine. Shield tracks 51 and 53 are positioned along the inner surface of the wall 12. Shields 44 and 48 move along tracks 51 and 53 respectively when the automatic teller machine moves.

The front operating panel 50 of automatic teller machine 26 extends outwardly from wall 12 from between about 7.62 cm. (3 inches) to 30.48 cm. (12 inches). The automatic teller machine is significantly deeper than it is wide and generally the automatic teller machines are about 76.2 cm. (30 inches) wide and 91.4 cm. (36 inches) deep.

In addition to a front operating panel 50, the automatic teller machine has a rear servicing panel 52, and often at least one side servicing panel 54. A vault door 55 on the rear servicing panel 52 permits access to the inside of the automatic teller machine. As showns in FIGS. 2–4 the automatic teller machine in enclosure 10 is capable of assuming at least three significant positions.

A lockable door 56 is formed in the rear portion 58 of wall 12. This door gives access to the inside of enclosure 10.

A locking drop bolt 60 permits the servicing person to selectively lock or unlock the base 30. In its locked state base 30 cannot be moved.

Figure 2:
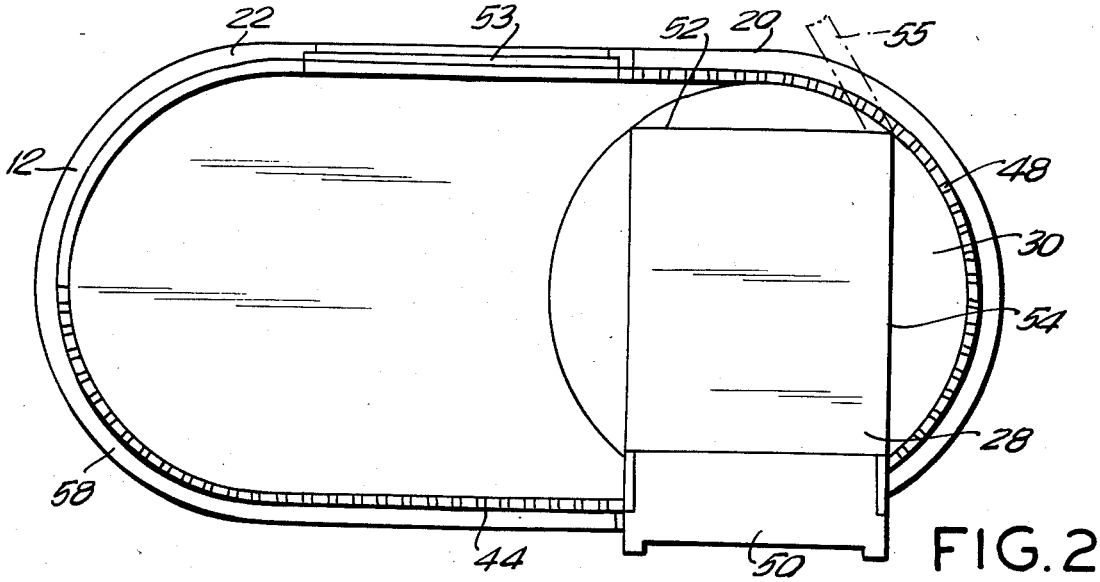
FIG. 2 is a horizontal schematic view of the enclosure showing the automatic teller machine in its first significant position.

FIG. 2 shows the automatic teller machine in its first significant position which is an operating position. The front panel 50 extends through cut-out zone 24. In this position the automatic teller machine is easily used by drivers in cars. However, in this position there is insufficient space available between the wall 12 and rear operating panel 52 to allow the vault door 55 to be swung open.

When one wants access to the automatic teller machine for servicing or replacement of funds, authorized service personnel can enter enclosure 10 through door 56. The drop bolt 60 can be unlocked so that base 30 can be rotated.

Figure 3:
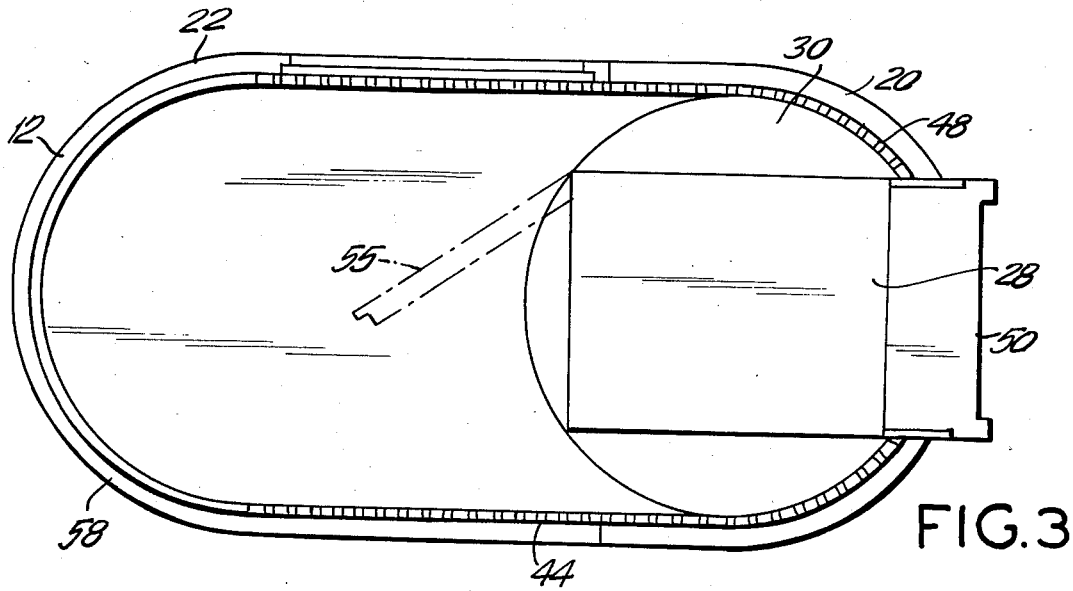
FIG. 3 is a schematic view analogous to FIG. 2 showing the automatic teller machine after is has been rotated 90% so that it is in its second significant position.

FIG. 3 shows the base 30 rotated 90° in a counterclockwise direction from its first significant position so that automatic teller machine 28 is in its second significant position. The shields 44 and 48 have moved the same amount and in the same direction as the automatic teller machine. In this position, service personnel have access to the rear servicing panel 52 of the automatic teller machine from within enclosure because sufficient space is available between the wall 12 and the rear operating panel to allow the vault door 55 to be swung open. Also there is access to the front operating panel 50 from the outside of the enclosure without moving the automatic teller machine back to its operating position. Shields 44 and 48 shield the cut-out zone and keep the service personnel out of view to ensure that the automatic teller machine is not compromised.

Figure 4:
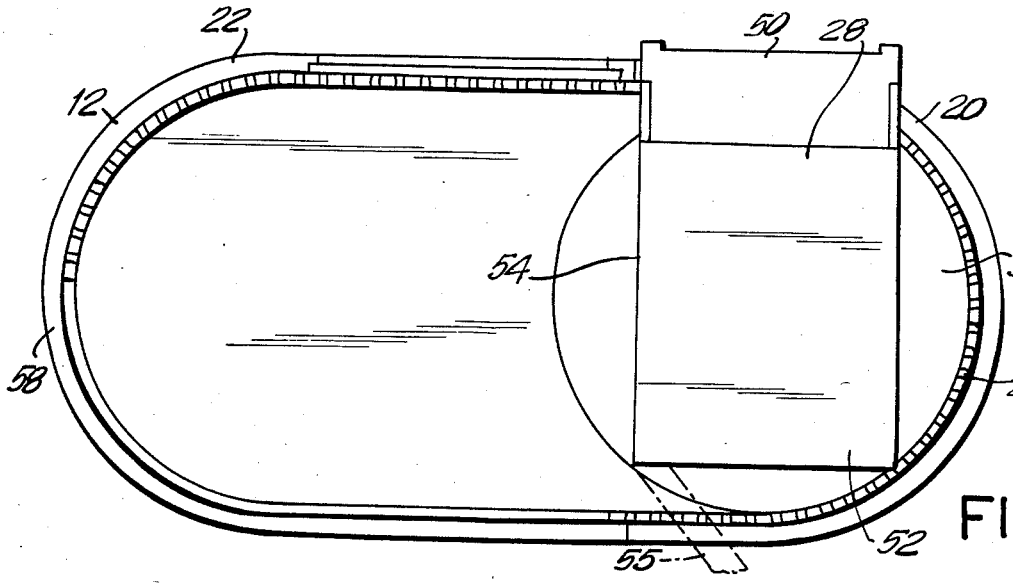
FIG. 4 is a schematic view analogous to FIG. 2 showing the automatic teller machine after it has been rotated 180% so that it is in its third significant position.

FIG. 4 shows the base rotated 180° in a counterclockwise direction from its first significant position, so that automatic teller machine 28 is in its third significant position. In this position the service personnel has access to serviceable side panel 54 and to front operating panel 50. Again shields 44 and 48 shield the cut-out zone and ensure that the automatic teller machine is not compromised. In this position there is insufficient space available between the wall 12 and rear operating panel 52 to allow the vault door 55 to be swung open.

The automatic teller machine enclosure permits access by users to the automatic teller machine in all significant positions while concomitively providing continuous security for the automatic teller machine.

Because of the dimensions and position of vault door 55 the automatic teller machine must be rotated to its second position in order to have sufficient space to open vault door 55 so that access to the rear panel 52 is possible.

The flexibility of shields 44 and 48 ensure that they can adequately shield the cut-out zone 24 in all significant positions and further ensure that access to the vault door of the automatic teller machine 28 is not blocked in the second significant position.

In another embodiment of the invention the base rotates only 90° so that the automatic teller machine 28 can assume only two significant positions which are identical to the positions shown in FIGS. 2 and 3 respectively.

In one embodiment of the invention, the drive-up island on which the enclosure 10 is installed is 1.22 m (4 ft.) by 2.44 m (8 ft.). The base 30 is circular and has a diameter of 1.02 m (3'6.2"); the front operating panel of the automatic teller machine has a width of 1.01 m (3 ft. 4 inches). The base and door are made of steel, the shield track is made of aluminum, and the enclosure wall is made of aluminum and has an insulation core on both sides thereof. The wall can be formed with a graffiti resistant finish and the enclosure may be constructed to include provisions for lighting, air conditioning and heating.

Enclosure 10 is formed so that it can securely accommodate all types of automatic teller machines presently being marketed.

What is claimed:

1. A compact, secure enclosure for an automatic teller machine, the teller machine having a secure front panel and an operable rear panel, the enclosure comprising:

an upright wall defining an enclosure for an automatic teller machine, said enclosure having a forward portion in which the automatic teller machine is located and a rearward portion sufficiently large to permit servicing the automatic teller machine from inside the enclosure, said upright wall including a substantial curved portion, said upright wall having a substantial rigid stationary segment, said stationary segment having a cut-out zone extending a substantial distance along said curved portion of said wall, the height of said cut-out zone being sufficient to accommodate the front face of the automatic teller machine, a flexible shield connected to both sides of the automatic teller machine and extending across said cut-out zone and along the inner surface of said curved portion of said stationary segment, said flexible shield providing a movable segment of said upright wall at said cut-out zone, a base capable of supporting the automatic teller machine, said base mounted for rotation within said enclosure, said base being capable of rotating so that the automatic teller machine when supported on said base can assume at least two significant positions, one of said positions being a normal use position and the other of said positions being a service position, a portion of said automatic teller machine projecting outward from said flexible shield segment of said wall through said cut-out zone when said automatic teller machine is supported on said base in either said first or said second significant positions such that the front face of the automatic teller machine is accessible to a user in both of said significant positions, said flexible shield being mounted for movement along the innner surface of said stationary segment of said wall, said shield being connected to said automatic teller machine for coordinated movement therewith across said cut-out zone as said base is rotated to provide continuous security for the cut-out zone, and a lockable door in said wall to allow a person to unlock same and enter into the rearward portion of said enclosure.

2. The enclosure of claim 1 wherein said base is capable of rotating at least 180° and wherein the automatic teller machine can assume three significant positions, said first significant position such that the front face of the automatic teller machine is accessible to a user, said second significant position such that both the front face and the rear panel of the automatic teller machine are accessible to a servicer, and said third significant position such that both a serviceable side panel and the front face of the automatic teller machine are accessible to a servicer.

3. The enclosure of claim 1 wherein said flexible shield is a sliding tambour panel.

4. The enclosure of claim 1 and additionally comprising groove wheels and a pipe track, said wheels positioned for movement along said track and said wheels supporting said base.

5. The enclosure of claim 4 and additionally comprising retaining means for retaining said wheels on said rail.

6. The enclosure of claim 1 and additionally comprising locking means for locking said base, said locking means capable of assuming a locked position such that said base cannot be rotated and an unlocked position such that said base can be rotated.

7. The enclosure of claim 1 wherein the projecting portion of the automatic teller machine projects from said wall from between about 7.5 cm. to about 31 cm.

* * * * *